US006648201B1

(12) United States Patent
Marinaro et al.

(10) Patent No.: US 6,648,201 B1
(45) Date of Patent: Nov. 18, 2003

(54) APPARATUS TO REDUCE WASTING OF UNUSED PHOTORESIST IN SEMICONDUCTOR CONTAINERS

(75) Inventors: Vincent Marinaro, Sunnyvale, CA (US); Ted Wakamiya, San Ramon, CA (US); Gerry Peffer, San Jose, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 81 days.

(21) Appl. No.: 10/050,514

(22) Filed: Jan. 16, 2002

(51) Int. Cl.[7] ..... B67D 5/60

(52) U.S. Cl. ..... 227/95; 222/105; 222/377; 222/464.7

(58) Field of Search ..... 222/95, 105, 321.5, 222/377, 464.7

(56) References Cited

U.S. PATENT DOCUMENTS 3,083,875 A * 4/1963 Welty et al. ..... 222/95
3,419,193 A * 12/1968 Stewart et al. ..... 222/464.7
3,863,809 A * 2/1975 Christine et al. ..... 222/105
5,062,549 A * 11/1991 Smith et al. ..... 222/464.7
5,102,010 A 4/1992 Osgar et al.
5,335,821 A * 8/1994 Osgar ..... 222/105
5,570,815 A * 11/1996 Ramsay ..... 222/95
5,749,500 A * 5/1998 Kraus et al. ..... 222/464.7
6,206,240 B1 3/2001 Osgar et al.
6,257,446 B1 * 7/2001 Pike ..... 222/464.7

OTHER PUBLICATIONS

"Chemical Management Gears Up for the Next Millennium", Alexander E. Braun, Cahners Semiconductor International, Aug., 1998, 7 pgs., reprinted from the Internet at: http://www.semiconductor.net/semiconductor/issues/Issues/1998/aug98/docs/feature2.asp.

"Chemical Management for the Future from ATMI Packaging", About Us, ATMI Packaging, reprinted from the Internet at: htt;://www.nowpak.com/about us.htm, 7 pgs.

"The NOWPak SmartProbe Key Coded Dispense Connection System", SmartProbe, ATMI Packaging, reprinted from the Internet at: http://www.nowpak.com/smartprobe.htm.. 2 pgs.

* cited by examiner

*Primary Examiner*—Kenneth Bomberg
(74) *Attorney, Agent, or Firm*—Eschweiler & Associates, LLC

(57) ABSTRACT

The present invention provides for a geometrically shaped pouch and container system for use in the storage, handling and dispensing of liquid chemicals. This system will result in far greater liquid chemical utilization efficiencies.

10 Claims, 14 Drawing Sheets

APPARATUS TO REDUCE WASTING OF UNUSED PHOTORESIST IN SEMICONDUCTOR CONTAINERS

TECHNICAL FIELD

The present invention relates to container assemblies used for the storage, handling, transport, and dispensing of liquid chemicals. In particular, the invention relates to a container assembly, which utilizes a film pouch located within a bottle, container, or over pack and is used in conjunction with dispensing systems for the distribution of semiconductor processing liquid chemicals in a manufacturing process.

BACKGROUND OF THE INVENTION

Presently the users of liquid chemicals have a limited choice of packaging, handling, delivery, and disposal methods for such materials such as acids, solvents, bases, photoresist, dopants, inorganics, organics, biological solutions, pharmaceuticals, and radioactive chemicals. One prior art system delivers chemicals from a bulk source, usually a 55-gallon drum, to the point of use. Usually these systems include the drums, piping, and automated delivery equipment, which makes such systems very expensive to use. As a result only a small amount of manufacturers, who have sufficient volumes to offset the equipment costs, use these systems.

Another widely used alternative is to handle the liquid chemicals in bottles made of glass or polyethylene. This method has several disadvantages. In particular, glass and polyethylene have been shown to contribute particulate contamination and metal-ion extractables, which significantly compromise the desired purity level of liquid chemicals. In addition, the dispensing methods used with glass and polyethylene bottles also compromise the purity of the chemical contents. Manual decanting exposes chemicals to atmospheric contamination, and also can compromise the safety of the technicians handling the bottles. With glass bottles there is the added danger of breakage with even the slightest abuse in handling. Disposal of empty bottles also becomes a concern. Sanitary disposal typically requires rinsing, tagging and crushing the used bottles. This process is quite expensive and may become an environmental concern.

Another alternative is the use of blow-molded fluoropolymer bottles. Manual handling of the bottle is maintained (as opposed to bulk delivery), yet the fluoropolymer bottle provides inertness, which is helpful to maintaining the purity of the chemicals being handled. Blow molded bottles can be expensive and usually are cost justified by use of a return program, however a returnable program presents numerous logistical problems for suppliers and users alike.

A final alternative is a bag in the bottle method in which a bag (or pouch) is inserted in a bottle (or container) and the fluid is extracted via a probe. A pressure is inserted between the bag and the bottle and forces the liquid out of the bag to a reservoir, which is connected to a pump. This method has its shortcomings in that a significant amount of fluid quite often resides in the bag after effective usage (e.g., liquid suction is lost allowing a residual amount of fluid to remain in the bag). In most cases the loss of this residual fluid is not significant, however, if the fluid involved is expensive or has a potential impact on the environment, then recovery of the residual fluid becomes advantageous (an exemplary type of fluid is photoresist). Consequently there is a continuing need for improved containers and storage systems, which allow the maximum amount of residual fluids to be extracted as possible.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its primary purpose is to present some concepts of the invention in a simplified form as a prelude to the more detailed description that is presented later.

The present invention is a container assembly for liquids, which comprises a pouch wherein liquid is stored, filled or emptied. The assembly further comprises an outer container, bottle or over pack that surrounds the pouch and a retaining means for engagement of the pouch to the outer container. The geometric shapes of the pouch, or the outer container, or a combination of both the pouch and the outer container are such that they facilitate the extraction process, thus ensuring that the maximum amount of residual fluids are utilized preventing excessive costs and environmental waste. For example, a bottom portion of the pouch is sloped toward a collection reservoir in the pouch, for example, in the middle thereof. Consequently, the photoresist material within the pouch is directed into the collection reservoir portion, wherein a liquid extraction member is located to remove photoresist therefrom.

According to one aspect of the invention, a semiconductor processing liquid containment assembly comprises a container and a pouch residing therein. The assembly also comprises a liquid extraction member that extends into the pouch for the removal of semiconductor processing liquid therefrom. The pouch or container (or both) have a bottom portion associated therewith that is configured to direct liquid within the pouch to a collection region associated therewith. The liquid extraction member extends into the collection region and is operable to extract the liquid therefrom. Due to the bottom configuration of the pouch and/or container the liquid within the pouch is directed into the collection region, thereby facilitating an efficient removal of liquid therefrom and reducing an amount of waste fluid remaining therein.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE INVENTION

The present invention will now be described with respect to the accompanying drawings in which like numbered elements represent like parts. In order to facilitate an understanding of various advantageous features of the present invention, a brief discussion of conventional semiconductor processing liquid containers will be discussed. Subsequently, the various features of the present invention will be discussed in detail in conjunction with several exemplary figures.

Figure 1:
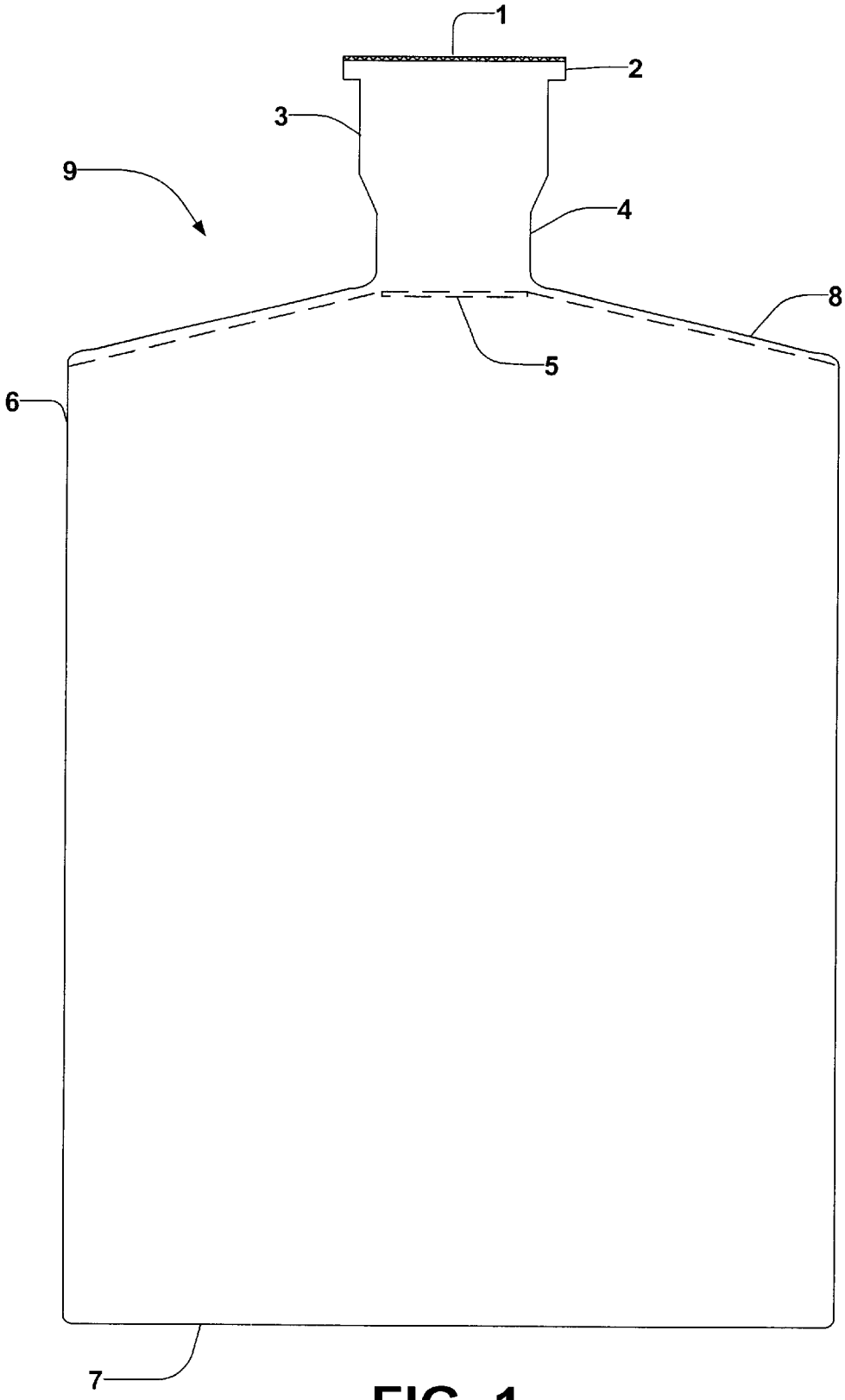
FIG. 1 (Prior Art)
FIG. 1 is a sectional view of an exemplary pouch used in prior art systems.

FIG. 1 is a sectional view of an exemplary pouch 9 (also called a bag) used in prior art systems. The pouch 9 is primarily used for liquid storage and is typically constructed of a fluoropolymer film (although other materials may be used) and may have additional laminations such as nylon, mylar, or metal foil added to the layer of fluoropolymer film. For example, a reflective metal foil may be used if the liquid stored within the pouch is a photoresist fluid. The pouch 9 includes a seal 1, a lip 2, a mouth 3, a neck 4, a lower shoulder or flange 5, a sidewall 6, a bottom 7 and a top 8, as illustrated.

Figure 2:
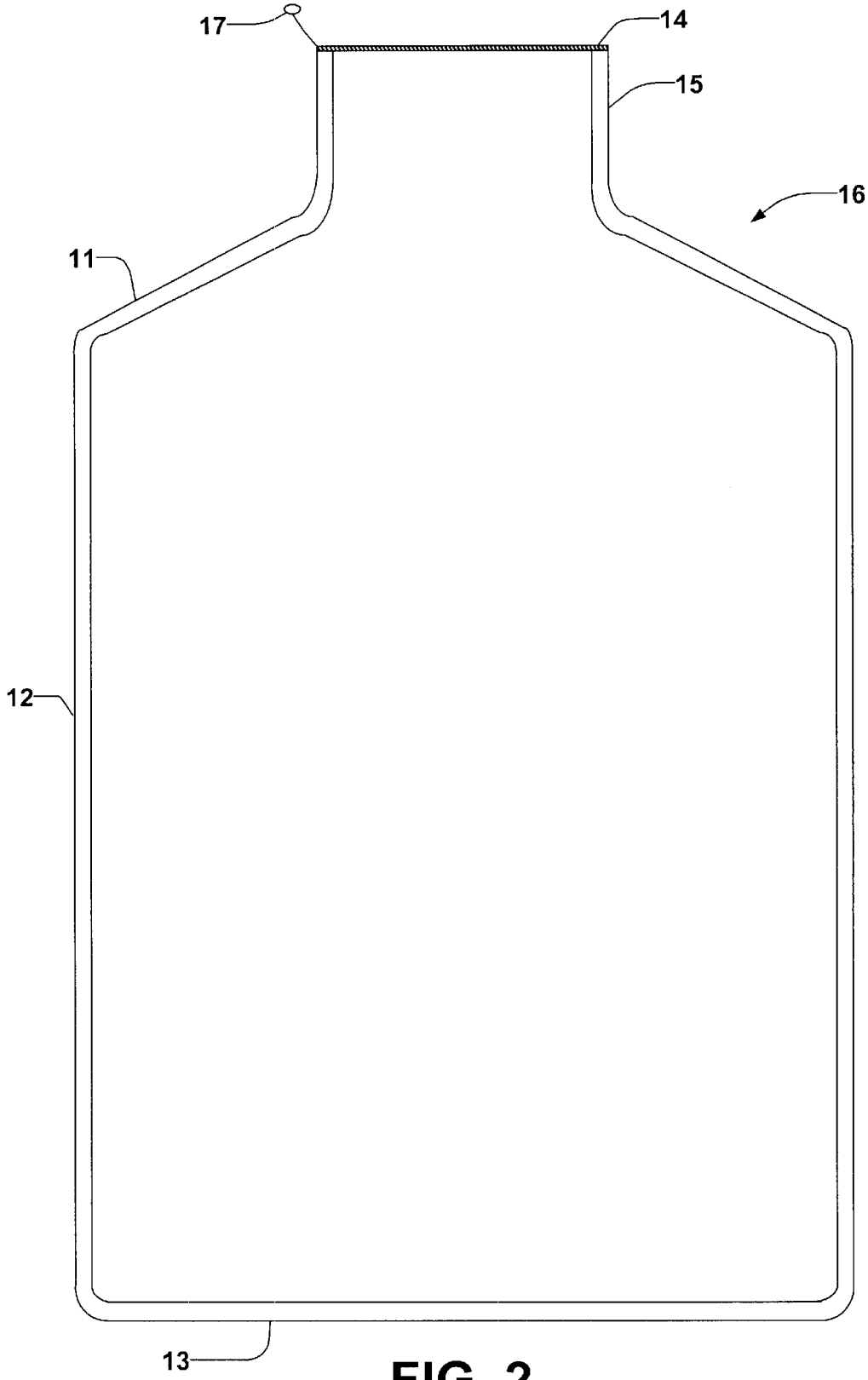
FIG. 2 (Prior Art)
FIG. 2 is a sectional view of an exemplary container used in prior art systems.

FIG. 2 is a sectional view of an exemplary container 16 (also called a bottle or over pack) used in prior art systems. The container 16 has a primary function of providing mechanical support and protection as required by the pouch 9 during filling, transport, handling, and dispensing of liquids. The container 16 is typically constructed of a plastic material such as polyethylene although other materials may be used. The container comprises a top wall 11, a sidewall 12, a bottom 13, a wide mouth 15, a membrane 14 and a tab 17 for removal of the membrane 14, as illustrated.

Figure 3:
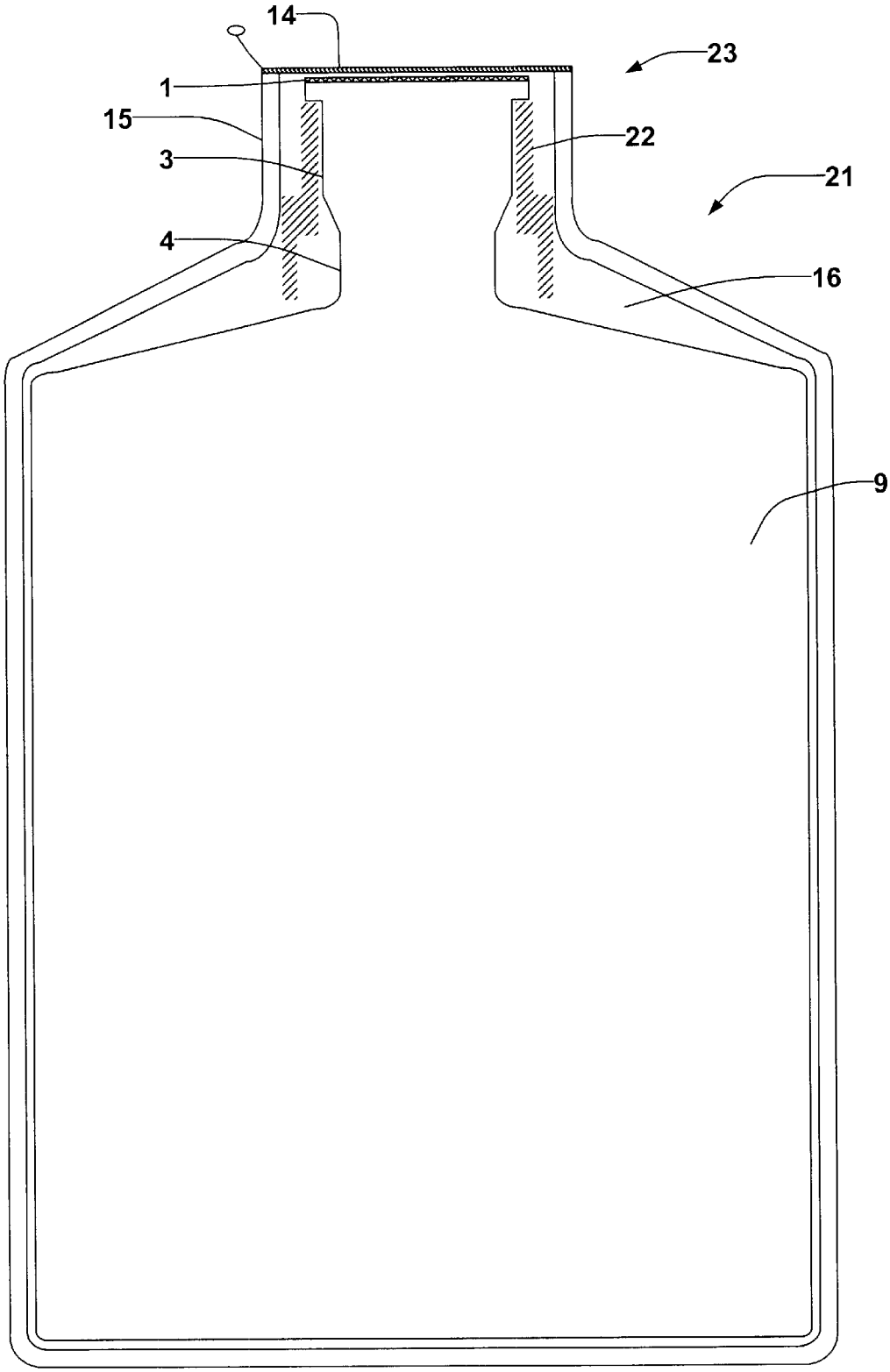
FIG. 3 (Prior Art)
FIG. 3 is a sectional view of the pouch and container of FIGS. 1 and 2, respectively, along with seals and a retainer used in exemplary prior art systems.

FIG. 3 is a sectional view of an exemplary container assembly 21 including the pouch 9 and the container 16 of FIGS. 1 and 2 used in prior art systems. An exemplary interface between the pouch 9 and the container 16 is illustrated in greater detail in FIG. 3. This assembly 21 comprises the pouch 9 and the container 16 joined together with a retaining 22 mechanism. Liquid is communicated from the assembly 21 to an external dispensing system (described later) via a communications port 23. This conmmunications port 23 is defined as the mouth 3, neck 4, and seal 1 of the pouch 9 combined with the retainer 22, the membrane 14 and the wide mouth 15 of the container 16. The retainer 22 ensures that the pouch 9 and the container 16 are joined or otherwise secured together at the communications port 23 during use and allows the pouch 9 to be separated from the container 16 for waste disposal after the pouch 9 is emptied.

Figure 4:
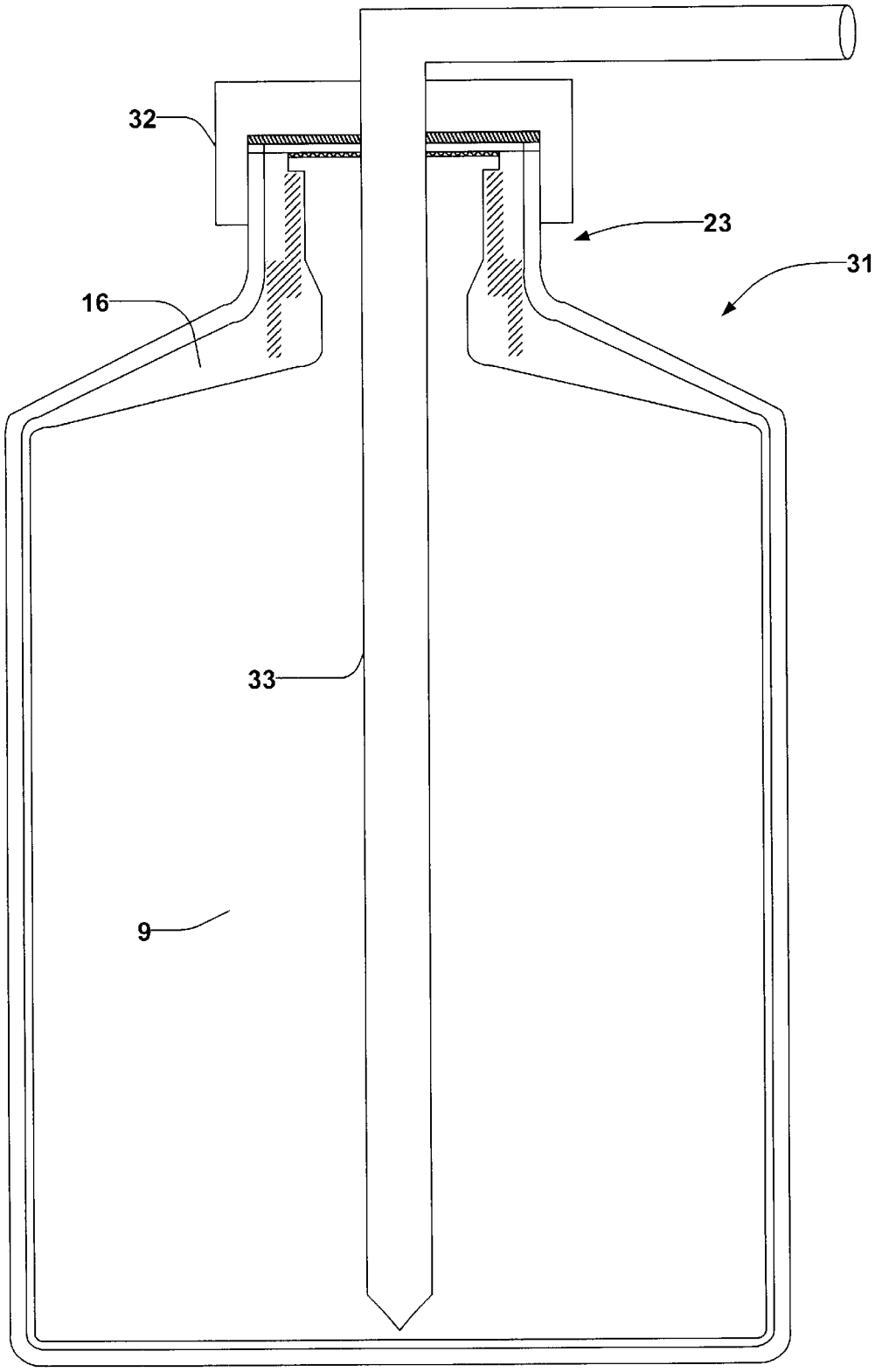
FIG. 4 (Prior Art)
FIG. 4 is a sectional view of the assembly of FIG. 3 with a probe used in exemplary prior art systems.

FIG. 4 is a sectional view of a conventional exemplary containment assembly 31 including the pouch 9, the container 16, and the communications port 23, of FIGS. 1–3, respectively, and further includes a probe connector 32 and a probe 33. The probe 33 is attached, via the probe connector 32, to the communications port 23 and penetrates the pouch 9 located in the container 16. This container assembly 31 provides a path for the liquid to flow into the chemical dispensing system (described below).

Figure 5:
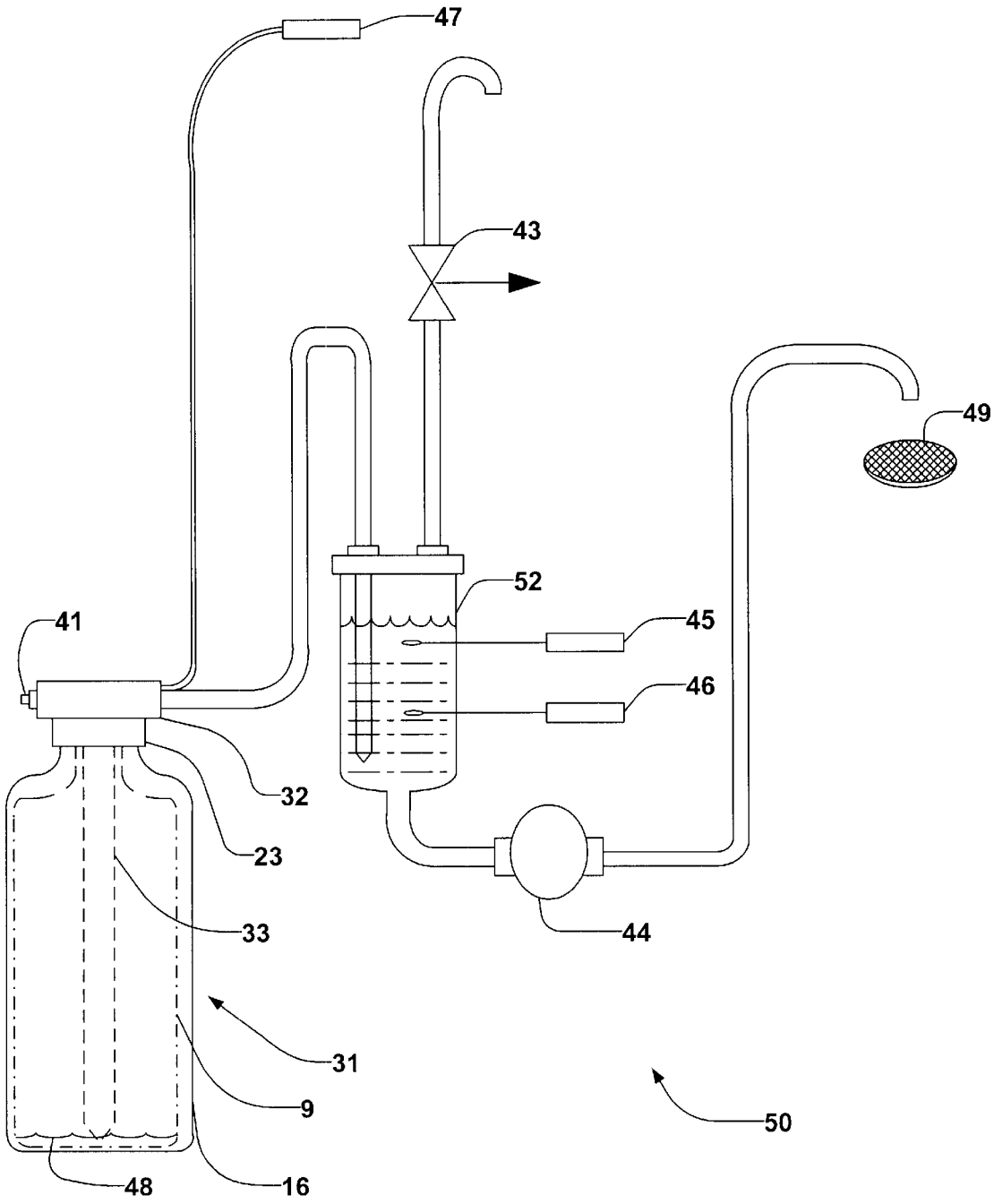
FIG. 5 (Prior Art)
FIG. 5 shows a typical liquid chemical dispensing system in a semiconductor processing operation.

FIG. 5 shows a typical liquid chemical dispensing system employing the conventional semiconductor processing liquid container assembly 31 of FIG. 4. In operation, a liquid chemical dispensing system 50 delivers liquid chemicals, such as a photoresist, that are contained within the pouch 9, to the manufacturing process 49, for example, to deposit on a wafer via spin-coating. When there is a proper connection between the probe connector 32 and the container assembly communication port 23, the pouch 9 is pressurized by introducing pressurized gas in the space between the pouch 9 and the container 16 via connection 41. The pressure in the container 16 is exerted on the pouch 9, which then delivers the contents of the liquid to a reservoir 52, via probe the 33. This process occurs as a vent valve 43 is opened.

The holding reservoir 52 within the liquid dispensing system 50 is best described with the introduction of a full container assembly 31 to dispensing system 50. First an operator connects the probe connector 32 to the container assembly communication port 23. This probe connector 32 is also connected to the probe 33, which is extended to the bottom of the container assembly 31. The probe 33 draws fluid, which is introduced to the reservoir 52. From the reservoir 52 the fluid is then pumped, via the pump 44, to its final destination 49. Sensors 45 and 46 monitor liquid levels in the reservoir 52 and enable pump 44 operation, given the proper conditions. If the sensors 45 and 46 sense that the liquid level is too low, a signal will be sent to the master controller (not shown) informing the system 50 that more chemicals are needed. Another sensor 47 monitors the probe connection, ensuring that the correct container is connected to the liquid dispensing system. If an incorrect container or an improper connection is made between the container assembly communication port 23 and the probe connector assembly 32, the pump 44 will be disabled.

A drawback with the present art of FIG. 5 is that the dispensing process 50 is unable to draw all of the fluid from the pouch 9 and therefore leaves a residual amount of liquid 48 therein. This residual liquid 48 is typically disposed, along with the pouch 9, as a waste product. The present invention overcomes this problem by collecting the fluid in a predetermined region of the pouch (to be described below). This inventive approach allows the probe 33 to have greater access to the fluid 48 and thus the dispensing system 50 is able to draw more fluid out of the pouch. The result of this process is that less fluid is wasted which is clearly beneficial from both an environmental and a cost perspective.

Figure 6:
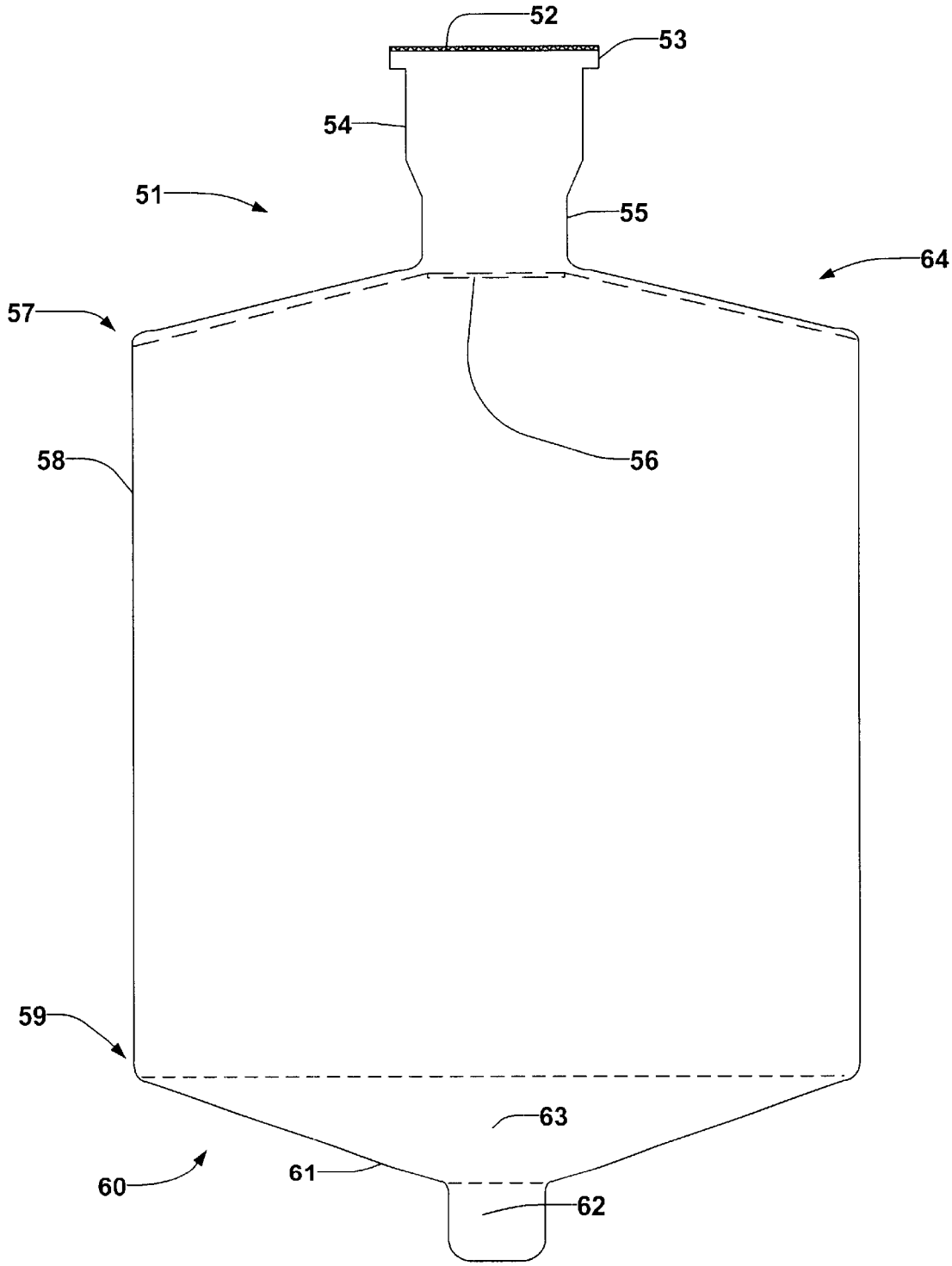
FIG. 6 is a sectional view of an exemplary pouch of the present invention using a geometrically shaped region, which has a conical shape to direct liquid to a predetermined region.

FIG. 6 is a sectional view of a pouch 64 according to one exemplary aspect of the present invention. The pouch 64 comprises a top portion 51, which comprises, for example, a seal portion 52 residing on a lip portion 53, as illustrated. The top portion 51 further comprises a mouth portion 54 extending from the lip 53 through which an extraction member such as a probe (not shown) may extend. The pouch 64 further includes a neck portion 55 extending from the mouth 54 to a lower shoulder or flange portion 56. The pouch 64 of the present invention further comprises an enclosed sidewall portion 58, which extends from a first end 57 coupled to the top portion 51 to a bottom portion 60 of the pouch.

The bottom portion 60 of the pouch 64 of FIG. 6 couples to the enclosed sidewall portion 58 at 59, and includes for example, a geometrically shaped portion 63, which extends from the sidewalls toward a predetermined collection region 62. In accordance with one example, the geometrically shaped portion 63 has a sloped edge 61, which is adapted to urge or direct a liquid within the pouch 64 toward the predetermined collection region 62. In accordance with one example, the sloped edges 61 form a generally inverted conical shape, which direct the liquid into the predetermined collection region 62. In addition, the predetermined collection region 62 in the example of FIG. 6 comprises a recess portion that is configured to interface with a bottom portion of a liquid extraction member or probe (not shown) which will be described in greater detail later.

Figure 7:
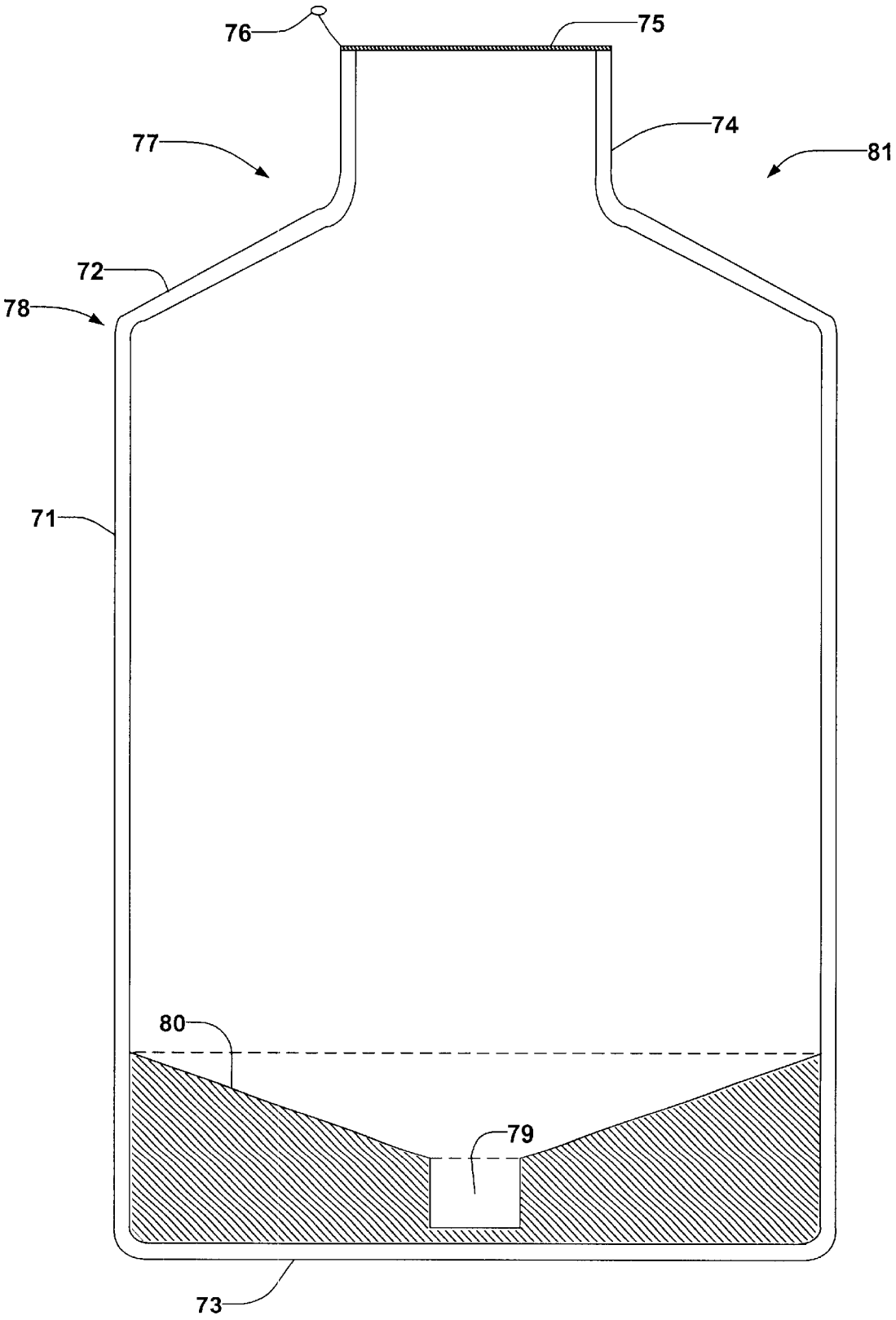
FIG. 7 is a sectional view of an exemplary container of the present invention using a geometrically shaped region, which has a conical shape to direct liquid to a predetermined region.

FIG. 7 is a sectional view of a container 81 according to one aspect of the present invention. The container 81 has a primary function of providing mechanical support and protection required by the pouch 64 during filling, transport, handling, and dispensing of liquids. The container is typically constructed of a plastic material such as polyethylene although other materials may be used. The container 81 comprises a top portion 77, which comprises, for example, a membrane removal tab 76 and a membrane 75 portion residing on a wide mouth 74 through which an extraction member such as a probe (not shown) may extend. The container 81 further includes a top shoulder 72, which extends to a sidewall portion 71. The top shoulder 72 is coupled a first end 78 of the sidewall portion 72. In addition, the sidewall portion 72 is coupled to a bottom portion 73 of the container. The bottom portion 73 comprises, for example, a geometrically shaped portion 80, which may be a permanent or removable insert, and extends from the sidewalls 71 to a predetermined collection region 79.

In accordance with one example, the geometrically shaped portion 80 has a sloped edge which is adapted to urge or direct liquid within the pouch 64 of FIG. 6. In accordance with one example 81, the sloped edges 80 form a generally inverted conical shape, which direct the liquid into the collection region 79 of the pouch of FIG. 6. Alternately, the container 81 supports a conventional pouch, for example, the pouch 9 of FIG. 1 and acts independently to direct liquid to a liquid collection region, located in the pouch 9, but formed by the container's 81 predetermined collection region 79. In addition the predetermined collection region 79 of the container 81 in the example of FIG. 7 comprises a recess portion that is configured to interface with a bottom portion of a liquid extraction member or probe (not shown) which will be described in greater detail later.

Figure 8:
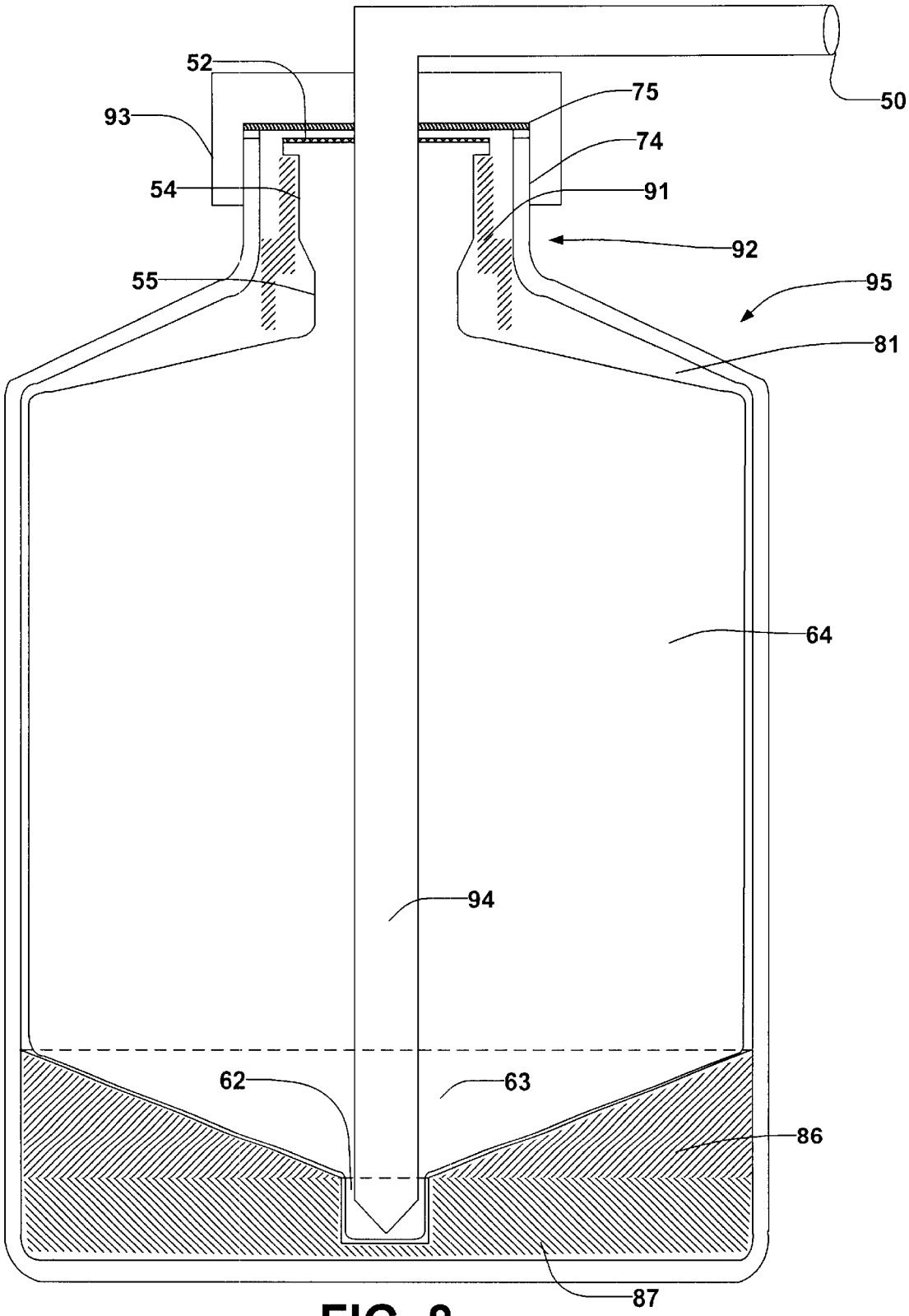
FIG. 8 is a sectional view of an exemplary container assembly containing a probe according to the present invention using a geometrically shaped region, which is a conical shape to direct liquid to a predetermined region.

FIG. 8 is a sectional view of an exemplary container assembly 95 including the pouch 64 and the container 81 of FIGS. 6 and 7. An exemplary interface between the pouch 64 and the container 81 is illustrated in greater detail in FIG. 8. This assembly 95 comprises the pouch 64 and the container 81 joined together with a retaining mechanism 91. Liquid is communicated from the assembly 95 to the external dispensing system 50 via a communications port 92. This exemplary communications port 92 is defined as the mouth 54, neck 55 and seal 52 of the pouch 64 combined with the retainer 91, the membrane 75 and the wide mouth 74 of the container 81. The retainer 91 ensures that the pouch 64 and the container 81 are joined or otherwise secured together at the communications port 92 during use and allows the pouch 64 to be separated from the container 81 for waste disposal after the pouch 64 is emptied.

A liquid extraction member or probe 94 is attached, for example, via a probe connector 93, to the communications port 92 and penetrates the pouch 64 located in the container 81. This container assembly 95 provides a path for the liquid to flow into the chemical dispensing system 50. As liquid is dispensed to the system 50 and the pouch 64 is drained, the remaining liquid is directed to the predetermined region 62 via the liquid's collection enhancing region 63. Note that as illustrated in FIG. 8 the container is being used in conjunction with the pouch 64, alternately the pouch 64 and the container 81 could perform the desired effect independently (e.g., a pouch 9 of FIG. 1 could have been combined with the container 81 of FIG. 7 to obtain the desired effect. Furthermore a pouch 64 of FIG. 6 could have been combined with the container 16 of FIG. 2 obtaining the desired effect). Region 86 supports the pouch's liquid collection enhancing region 63 and region 87 supports the pouch's predetermined liquid collection region 62. FIG. 8 clearly illustrates the advantage of the present invention in which the extraction port of the liquid extraction member or probe 94 engages the predetermined region 62 and thus has greater access to any remaining fluid for transmission to the dispensing system 50 resulting in waste elimination.

Figure 9:
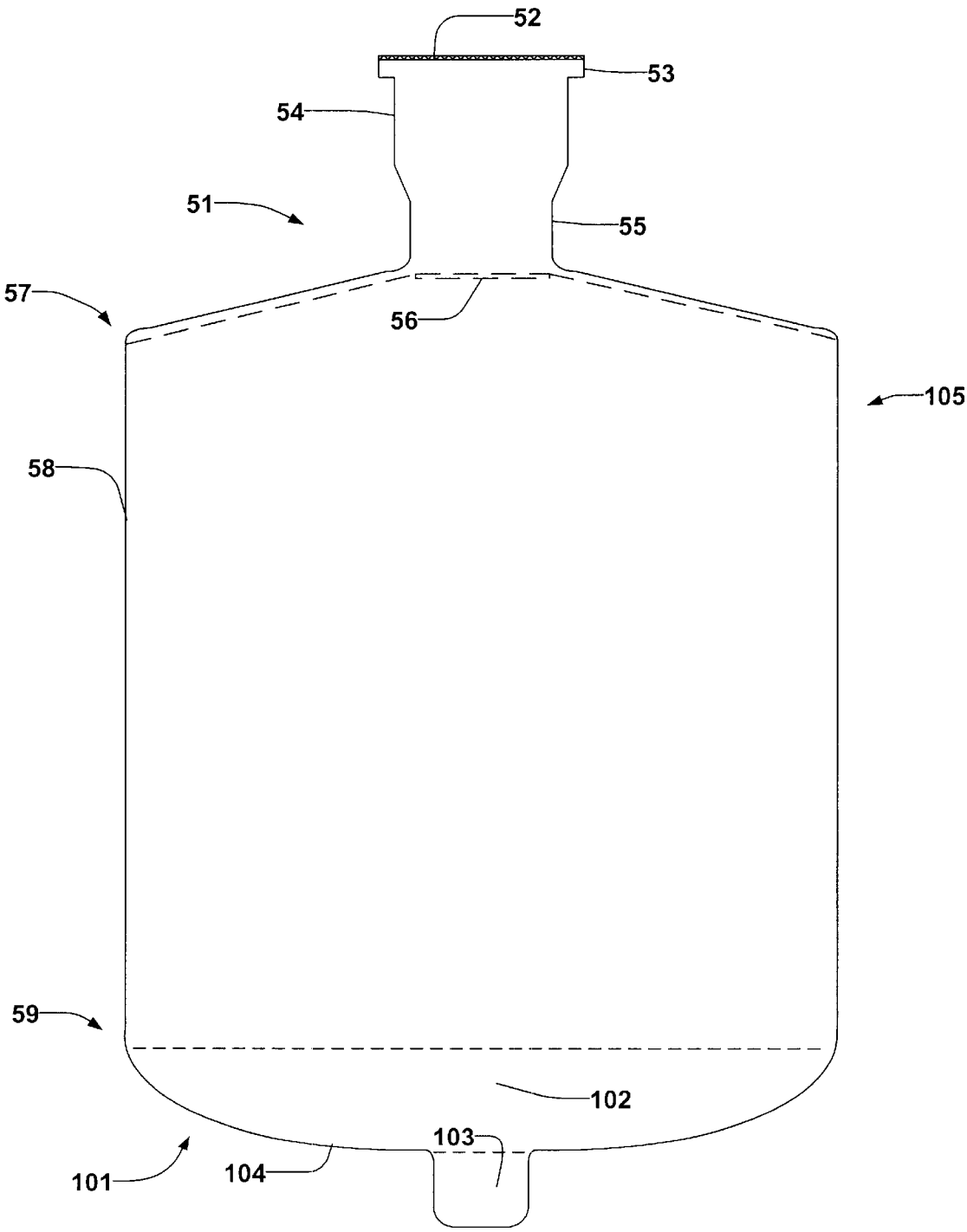
FIG. 9 is a sectional view of an exemplary pouch of the present invention using a geometrically shaped region, which is a rounded shape to direct liquid to a predetermined region.

FIG. 9 is a sectional view of a pouch 105 according to another exemplary aspect of the present invention. The pouch 105 comprises a top portion 51, which comprises, for example, a seal portion 52 residing on a lip portion 53, as illustrated. The top portion 51 further comprises a mouth portion 54 extending from the lip 53 through which an extraction member such as a probe (not shown) may extend. The pouch 105 further includes a neck portion 55 extending from the mouth 54 to a lower shoulder or flange portion 56. The pouch 105 of the present invention further comprises an enclosed sidewall portion 58, which extends from a first end 57 coupled to the top portion 51 to a bottom portion 59 of the pouch.

The bottom portion 101 of the pouch 105 of FIG. 9 couples to the enclosed sidewall portion 58 at end 59, and includes for example, a geometrically shaped portion 102, which extends from the sidewalls toward a predetermined collection region 103. In accordance with one example, the geometrically shaped portion 102 has a rounded shape 104, which is adapted to urge or direct a liquid within the pouch 105 toward the predetermined collection region 103. In accordance with one example, the rounded edges 104 form a bowl shape, which directs the liquid into the collection region 103. In addition, the predetermined collection region 103 in the example of FIG. 9 comprises a recess portion that is configured to interface with a bottom portion of a liquid extraction member or probe (not shown) which will be described in greater detail later.

Figure 10:
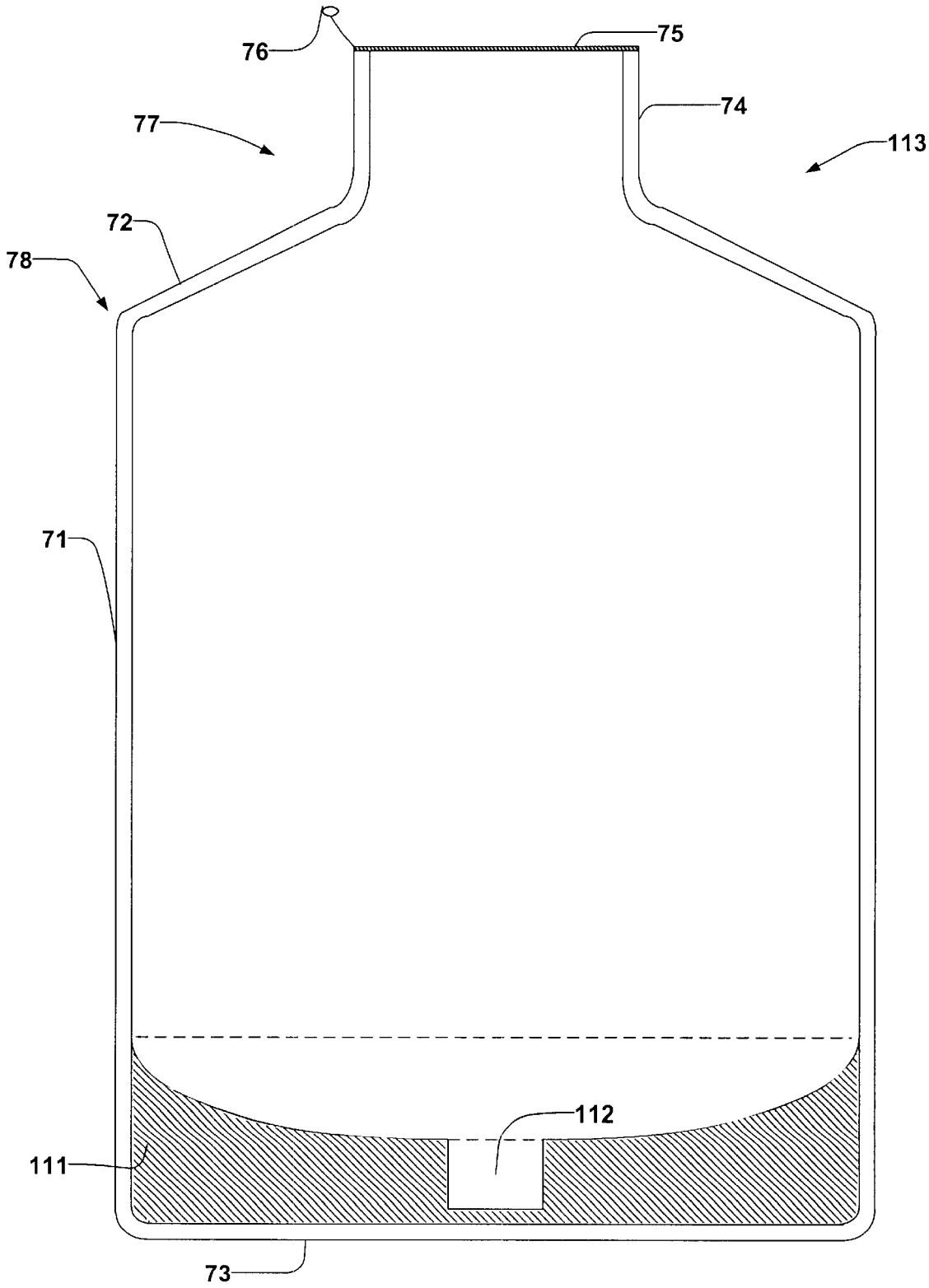
FIG. 10 is a sectional view of an exemplary container of the present invention using a geometrically shaped region, which is a rounded shape to direct liquid to a predetermined region.

FIG. 10 is a sectional view of a container 113 according to one aspect of the present invention. The container 113 has a primary function of providing mechanical support and protection required by the pouch 105 during filling, transport, handling, and dispensing of liquids. The container is typically constructed of a plastic material such as polyethylene although other materials may be used. The container 113 comprises a top portion 77, which comprises, for example, a membrane removal tab 76 and a membrane 75 portion residing on a wide mouth 74 through which an extraction member such as a probe (not shown) may extend. The container 113 further includes a top shoulder 72, which extends to a sidewall portion 71. The top shoulder 72 is coupled to a first end 78 of the sidewall portion 71. In addition, the sidewall portion 71 is coupled to a bottom portion 73 of the container. The bottom portion 73 comprises, for example, a geometrically shaped portion 111, which may be a permanent or removable insert, and extends from the sidewalls 71 to a predetermined collection region 112.

In accordance with the present example, the geometrically shaped portion 111 has a rounded shape which is adapted to urge or direct liquid within the pouch 105 of FIG. 6. In accordance with one example, the rounded shape 111 forms a general bowl shape, which directs the liquid into the collection region 112 of the pouch of FIG. 6. Alternately, the container 113 supports a pouch, for example, the pouch 9 of FIG. 1 and acts independently to direct liquid to a liquid collection region, located in the pouch 9, but formed by the container's 113 predetermined collection region 112. In addition the predetermined collection region 112 of the container 113 comprises in the example of FIG. 10 a recess portion that is configured to interface with a bottom portion of a liquid extraction member or probe (not shown) which will be described in greater detail later.

Figure 11:
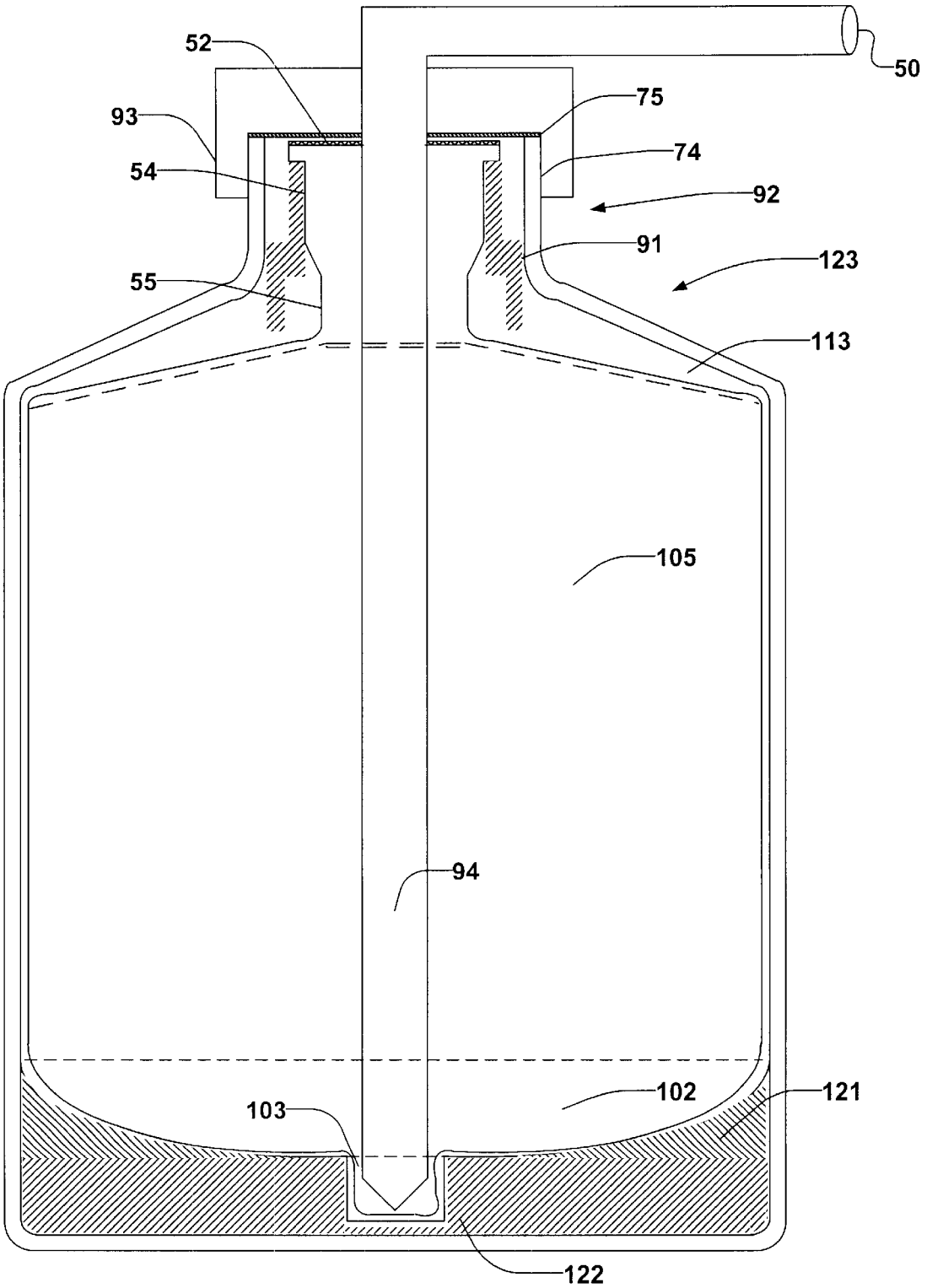
FIG. 11 is a sectional view of an exemplary container assembly containing a probe according to the present invention using a geometrically shaped region, which is a rounded shape to direct liquid to a predetermined region.

FIG. 11 is a sectional view of an exemplary container assembly 123 including the pouch 105 and the container 113 of FIGS. 9 and 10. An exemplary interface between the pouch 105 and the container 113 is illustrated in greater detail in FIG. 11. This assembly 123 comprises the pouch 105 and the container 113 joined together with a retaining 91 mechanism. Liquid is communicated from the assembly 123 to the external dispensing system 50 via a communications port 92. This communications port 92 is defined as the mouth 54, neck 55, and seal 52 of the pouch 105 combined with the retainer 91, the membrane 75 and the wide mouth 74 of the container 113. The retainer 91 ensures that the pouch 105 and the container 113 are joined or otherwise secured together at the communications port 92 during use and allows the pouch 105 to be separated from the container 113 for waste disposal after the pouch 105 is emptied.

A liquid extraction member or probe 94 is attached, via a probe connector 93, to the communications port 92 and penetrates the pouch 105 located in the container 113. This container assembly 123 provides a path for the liquid to flow into the chemical dispensing system 50. As liquid is dispensed to the system 50 and the pouch 105 is drained, the remaining liquid is directed to the predetermined region 103 via the liquid's collection enhancing region 102. Note that as illustrated in FIG. 11 the container 113 is being used in conjunction with the pouch 105, alternately the pouch 105 and the container 113 could perform the desired effect independently as needed (e.g., a pouch 9 of FIG. 1 could have been combined with the container 113 of FIG. 10 to obtain the desired effect. Furthermore a pouch 105 of FIG. 9 could have been combined with the container 16 of FIG. 2 obtaining the desired effect). Region 121 supports the pouch's liquid collection enhancing region 102 and region 122 supports the pouch's predetermined liquid collection region 103. FIG. 11 clearly illustrates the advantage of the present invention in which the liquid extraction port of the liquid extraction member or probe 94 extends into the predetermined region 103 and thus has greater access to any remaining fluid for transmission to the dispensing system 50 resulting in waste elimination.

Figure 12:
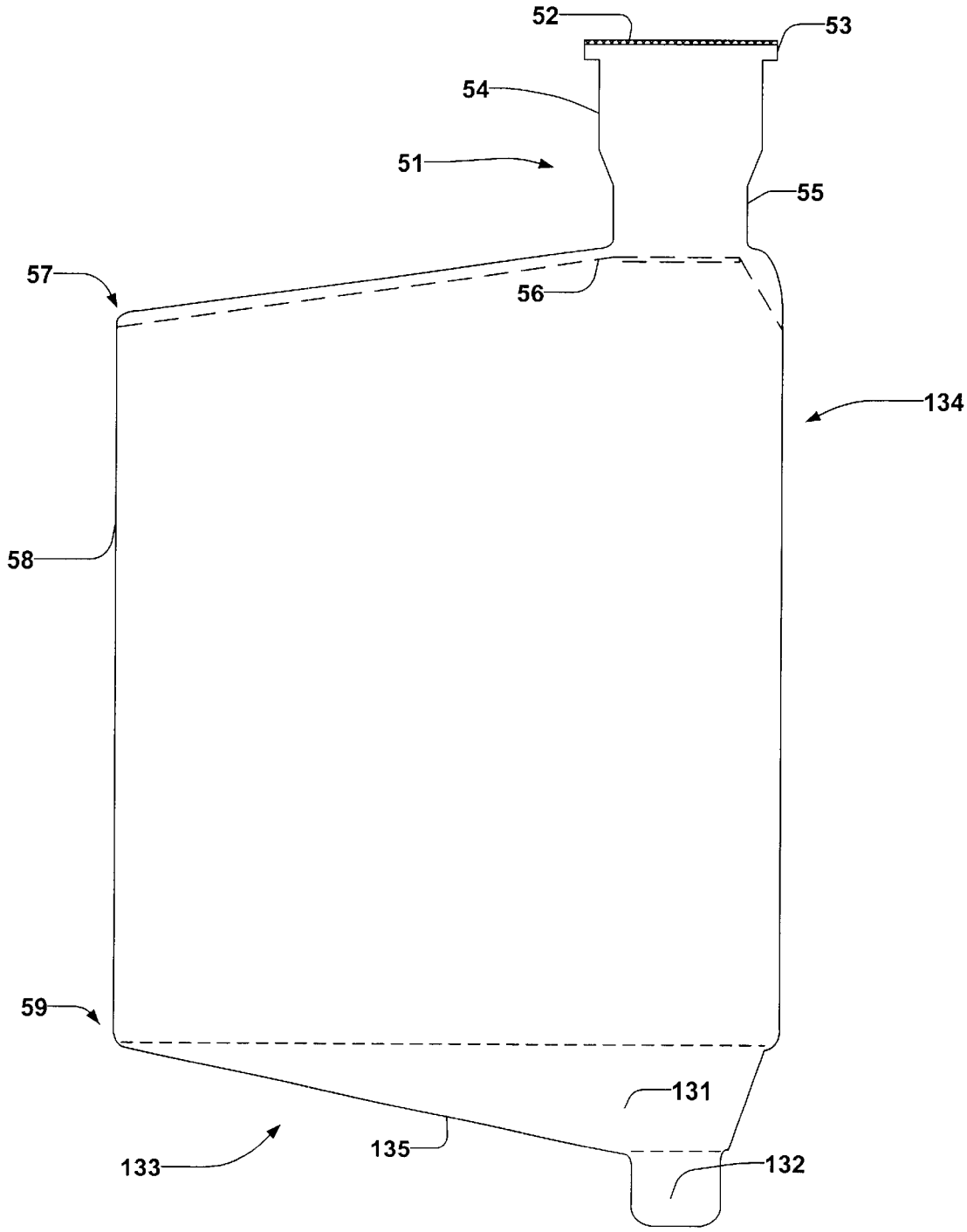
FIG. 12 is a sectional view of another exemplary pouch of the present invention using a geometrically shaped region having a gradient to direct liquid to a predetermined region.

FIG. 12 is a sectional view of a pouch 134 according to yet another exemplary aspect of the present invention. The pouch 134 comprises a top portion 51, which comprises, for example, a seal portion 52 residing on a lip portion 53, as illustrated. The top portion 51 further comprises a mouth portion 54 extending from the lip 53 through which an extraction member such as a probe (not shown) may extend. The pouch 134 further includes a neck portion 55 extending from the mouth 54 to a lower shoulder or flange portion 56. The pouch 134 of the present invention further comprises an enclosed sidewall portion 58, which extends from a first end 57 coupled to the top portion 51 to a bottom portion 133 of the pouch.

The bottom portion 133 of the pouch 134 of FIG. 12 couples to the enclosed sidewall portion 58 at 59, and includes for example, a geometrically shaped portion 131, which extends from the sidewalls toward a predetermined collection region 132. In accordance with the present example, the geometrically shaped portion 131 has a gradient shaped edge 135, which is adapted to urge or direct a liquid within the pouch 134 toward the predetermined collection region 132. In accordance with this example, the gradient shaped edge 135 forms a decline, which directs the liquid into the predetermined collection region 132 near a side portion of the pouch 134. In addition, the predetermined collection region 132 in the example of FIG. 12 comprises a recess portion that is configured to the interface with a bottom portion of a liquid extraction member or probe (not shown) which will be described in greater detail later.

Figure 13:
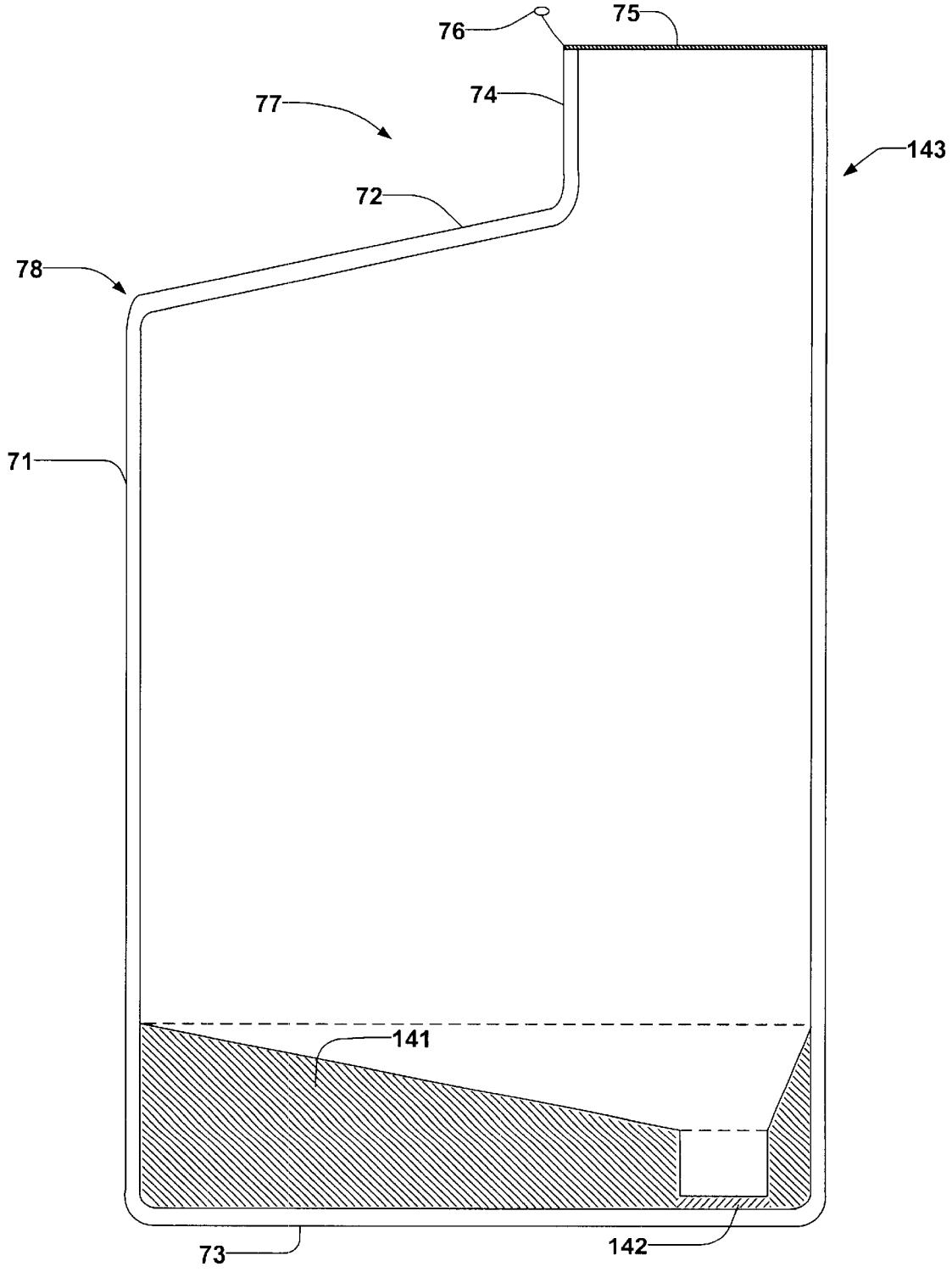
FIG. 13 is a sectional view of another exemplary container of the present invention using a geometrically shaped region, having a gradient to direct liquid to a predetermined region.

FIG. 13 is a sectional view of a container 143 according to one aspect of the present invention. The container 143 has a primary function of providing mechanical support and protection required by the pouch 134 during filling, transport, handling, and dispensing of liquids. The container is typically constructed of a plastic material such as polyethylene although other materials may be used. The container 143 comprises a top portion 77, which comprises, for example, a membrane removal tab 76 and a membrane 75 portion residing on a wide mouth 74 through which an extraction member such as a probe (not shown) may extend. The container 143 further includes a top shoulder 72, which extends to a sidewall portion 71. The top shoulder 72 is coupled a first end 78 of the sidewall portion 71. In addition, the sidewall portion 71 is coupled to a bottom portion 73 of the container. The bottom portion 73 comprises, for example, a geometrically shaped portion 141, which may be a permanent or removable insert, extends from the sidewalls 71 to a predetermined collection region 142. In accordance with one example, the geometrically shaped portion 141 has a gradient shape which is adapted to urge or direct liquid within the pouch 134 of FIG. 12. In accordance with one example the gradient shape 141 forms an incline, which directs the liquid into the collection region 132 of the pouch 134 of FIG. 12. Alternately, the container 143 supports a pouch, for example, the pouch 9 of FIG. 1 and acts independently to direct liquid to a liquid collection region, located in the pouch 9, but formed by the container's 143 predetermined collection region 142. In addition the predetermined collection region 142 of the container 143 in the example of FIG. 13 comprises a recess portion that is configured to interface with a bottom portion of a liquid extraction member or probe (not shown) which will be described in greater detail later.

Figure 14:
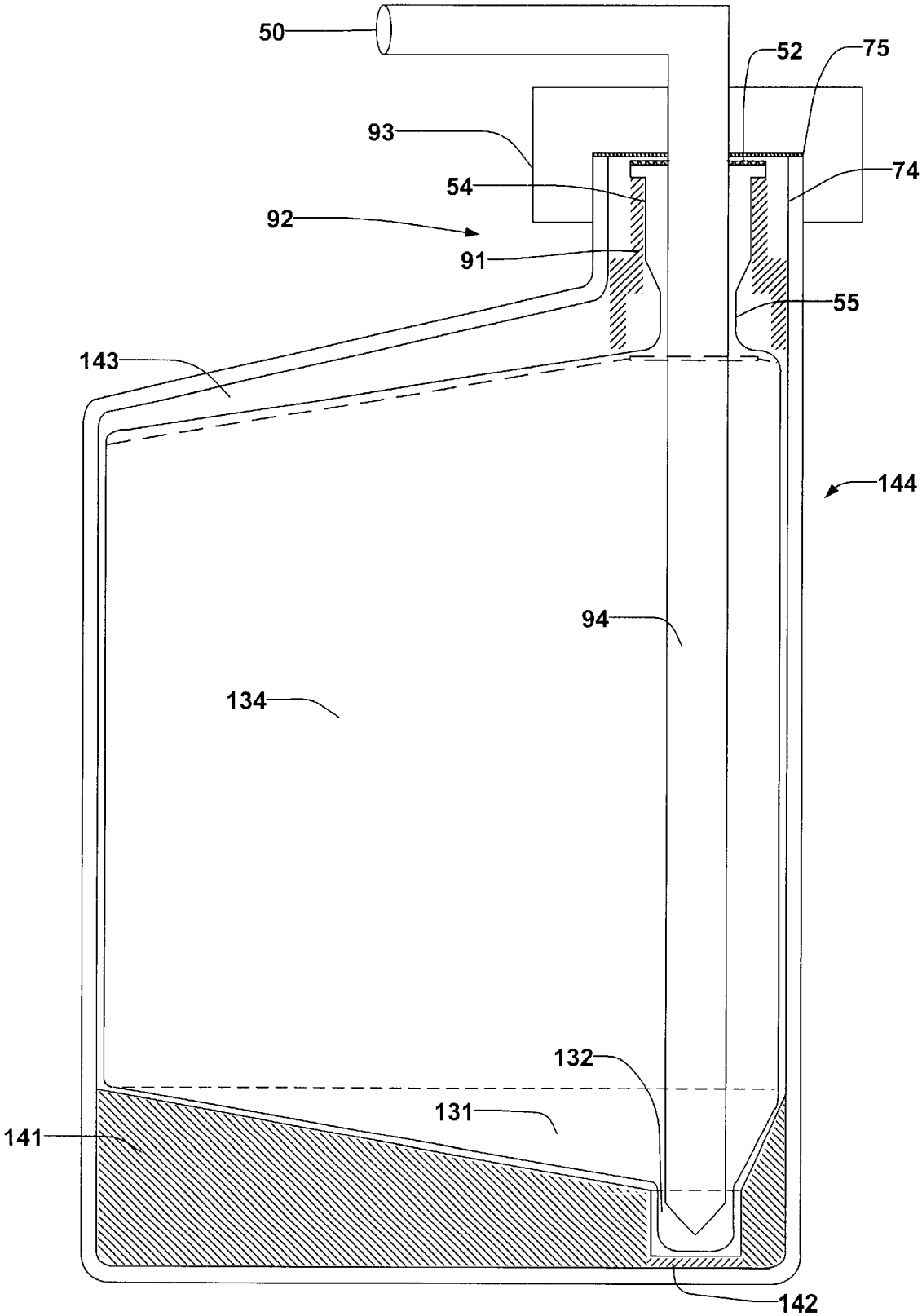
FIG. 14 is a sectional view of another exemplary container assembly containing a probe according to the present invention using a geometrically shaped region having a gradient to direct liquid to a predetermined region.

FIG. 14 is a sectional view of an exemplary container assembly 144 including the pouch 134 and the container 143 of FIGS. 12 and 13. An exemplary interface between the pouch 134 and the container 143 is illustrated in greater detail in FIG. 14. This assembly 144 comprises the pouch 134 and the container 143 joined together with a retaining 91 mechanism. Liquid is communicated from the assembly 144 to the external dispensing system 50 via a communications port 92. This communications port 92 is defined as the mouth 54, neck 55, and seal 52 of the pouch 134 combined with the retainer 91, the membrane 75 and the wide mouth 74 of the container 143. The retainer 91 ensures that the pouch 134 and the container 144 are joined or otherwise secured together at the communications port 91 during use and allows the pouch 134 to be separated from the container 143 for waste disposal after the pouch 134 is emptied.

A liquid extraction member or probe 94 is attached, via a probe connector 93, to the communications port 92 and penetrates the pouch 134 located in the container 143. This container assembly 144 provides a path for the liquid to flow into the chemical dispensing system 50. As liquid is dispensed to the system 50 and the pouch 134 is drained, the remaining liquid is directed to the predetermined region 132 via the liquid's collection enhancing region 131. Note that as illustrated in FIG. 14 the container is being used in conjunction with the pouch 134, alternately the pouch 134 and the container 143 could perform the desired effect independently as needed (e.g., a pouch 9 of FIG. 1 could have been combined with the container 143 of FIG. 13 to obtain the desired effect. Furthermore a pouch 143 of FIG. 12 could have been combined with the container 16 of FIG. 2 obtaining the desired effect). Region 141 supports the pouch's liquid collection enhancing region 131 and region 142 supports the pouch's predetermined liquid collection region 132. FIG. 14 clearly illustrates the advantage of the present invention in which the liquid extraction member or probe 94 has greater access to any remaining fluid for transmission to the dispensing system 50 resulting in waste elimination.

As can be clearly seen from the detailed descriptions, it is concluded that problems resulting in wasted residual fluid, which is inherent in the prior art, are overcome by the present invention and its variations (some of which are presented as examples). It should be noted that there are several obvious issues associated with the prior art such as waste fluid levels between 35 ml to 500 ml of photoresist per bag (which was observed by the applicant and thus provided motivation for this invention). The disposal of this unused photoresist is very costly especially when considering that photoresist currently costs approximately $2000 per gallon (this photoresist is only expected to become more expensive in the future). Additionally, an unnecessarily impact on the environment occurs during the disposal of unused photoresist. The present invention clearly results in reduced waste, which will have a positive effect on both the environment and the cost aspects of the system.

Although the invention has been shown and described with respect to a certain implementation or implementations, it will be appreciated by those skilled in the art that equivalent alterations and modifications will occur to others skilled in the art upon the reading and understanding of this specification and the annexed drawings. In particular regard to the various functions performed by the above described components (assemblies, devices, circuits, etc.), the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several implementations or applications of the invention, such feature may be combined with one or more other features of the other implementations as may be desired and advantageous for any given or particular application. Furthermore, to the extent that the term, "includes", "has", "having", and/or variants thereof are used in either the detailed description or the claims, such terms are intended to be inclusive in a manner similar to the terms "comprises" and "comprising".

What is claimed is:

1. A semiconductor processing liquid containment apparatus comprising:

a container having a mouth portion associated therewith;

a pouch within the container for holding a semiconductor processing liquid therein, and having a mouth portion associated therewith secured to the mouth portion of the container, wherein a bottom portion of the container or the pouch is adapted to direct the semiconductor processing liquid within the pouch to a predetermined collection region; and a semiconductor processing liquid extraction member adapted to interface with the mouth portion of the container and the pouch wherein the semiconductor processing liquid extraction member comprises an extraction port adapted to reside within the predetermined collection region of the pouch, wherein the container further comprises:

a top portion containing the mouth portion of the container;

an enclosed sidewall portion coupled to the top portion and providing a sidewall support for the pouch therein, and;

a bottom portion coupled to the enclosed sidewall portion opposite the top portion, the bottom portion comprising:

a predetermined collection region support portion; and a geometrically shaped region extending from at least a portion of the enclosed sidewall portion to the predetermined collection region support portion, and adapted to direct the semiconductor processing liquid in the bottom portion of the pouch to the predetermined collection region, wherein the geometrically shaped region comprises an insert placed in the bottom portion of the container and defines the predetermined collection region support portion, the geometrically shaped region being flush with the enclosed sidewall portion.

2. The semiconductor processing liquid containment apparatus of claim 1, wherein the geometrically shaped region of the container comprises a generally inverted conical shape having a conical base portion coupled to the enclosed sidewall portion of the container, and an inverted cone portion extending from the conical base portion to a focal region coupled to the predetermined collection region support portion, wherein the inverted cone portion is adapted to direct semiconductor processing liquid within the pouch to a predetermined collection region in the pouch associated with the predetermined collection region support portion of the container.

3. The semiconductor processing liquid containment apparatus of claim 1, wherein the geometrically shaped region of the container is adapted to provide a gradient to direct semiconductor processing liquid within the pouch to the predetermined collection region.

4. The semiconductor processing liquid containment apparatus of claim 1 wherein the predetermined collection region support portion is located in a generally center portion of the bottom portion of the container.

5. The semiconductor processing liquid containment apparatus of claim 1, wherein the pouch further comprises:

a top portion containing the mouth portion of the pouch;

an enclosed sidewall portion coupled to the top portion and providing a sidewall support for semiconductor processing liquid therein;

a bottom portion coupled to the enclosed sidewall portion of the pouch opposite the top portion, the bottom portion comprising:

a geometrically shaped portion extending from at least a portion of the enclosed sidewall portion of the pouch to predetermined collection region.

6. The semiconductor processing liquid containment apparatus of claim 5, wherein the predetermined collection region comprises a recess portion associated with the bottom portion of the pouch, and adapted to receive semiconductor processing liquid directed thereto via the geometrically shaped portion of the pouch.

7. The semiconductor processing liquid containment apparatus of claim 6, wherein the semiconductor processing liquid extraction member comprises an elongate tubular member extending from a first end associated with the mouth of the container to a second end associated with the recess portion of the pouch, and wherein the second end contains the extraction port for removal of semiconductor processing liquid from the recess portion via the elongate tubular member.

8. The semiconductor processing liquid containment apparatus of claim 5, wherein the geometrically shaped region of the pouch comprises a generally inverted conical shape having a conical base portion coupled to the enclosed sidewall portion of the pouch, and an inverted cone portion extending from the conical base portion to a focal region coupled to the predetermined collection region support portion, wherein the inverted cone portion is adapted to direct semiconductor processing liquid within the pouch to a predetermined collection region within the pouch.

9. The semiconductor processing liquid containment apparatus of claim 5, wherein the geometrically shaped region of the pouch is adapted to provide a gradient to direct semiconductor processing liquid within the pouch to the predetermined collection region.

10. The semiconductor processing liquid containment apparatus of claim 5 wherein the predetermined collection region portion is located in a generally center portion of the bottom portion of the container.

* * * * *